US005267677A

United States Patent [19]

Nash

[11] Patent Number: 5,267,677

[45] Date of Patent: Dec. 7, 1993

[54] ATHLETIC GLOVE POCKET FORMER, SHAPER AND CONDITIONING DEVICE

[76] Inventor: Lawrence A. Nash, 282 Dickens St., Northfield, Ill. 60093

[21] Appl. No.: 813,895

[22] Filed: Dec. 23, 1991

[51] Int. Cl.[5] ..... A41D 1/00

[52] U.S. Cl. ..... 223/78; 223/79; 2/19

[58] Field of Search ..... 223/78, 79, 80, 52, 223/51, 100; 2/19; 206/315.1; 401/213, 208, 209; 313/317, 324; D26/2, 1, 4

[56] References Cited

U.S. PATENT DOCUMENTS

| | | | |
|---|---|---|---|
| D. 79,472 | 9/1929 | Niebel | D26/2 |
| D. 221,156 | 7/1971 | Dorman | D26/2 |
| D. 730,852 | 6/1903 | Elliott | D26/2 X |
| 1,583,245 | 5/1926 | Causey | 223/100 |
| 2,472,016 | 5/1949 | Hungerford | 223/100 |
| 2,623,987 | 12/1952 | Conlin | 223/100 X |
| 3,259,935 | 7/1966 | Miller | 401/213 |
| 4,061,170 | 12/1977 | Marks | 150/52 R |
| 4,254,363 | 3/1981 | Walsh | D26/2 X |
| 4,418,849 | 12/1983 | Santa | 223/78 |
| 4,565,287 | 1/1986 | Rede et al. | 223/78 X |
| 4,588,320 | 5/1986 | Weinstein | 401/209 X |
| 4,765,519 | 8/1988 | Groves | 223/78 |
| 4,877,162 | 10/1989 | McGinley | 223/78 |
| 4,883,170 | 11/1989 | Wright | 206/315.1 |
| 4,958,729 | 9/1990 | Wright | 206/315.1 |
| 5,000,317 | 3/1991 | Cich | 206/315.1 |
| 5,011,053 | 4/1991 | Davies | 223/78 |
| 5,051,016 | 9/1991 | Bengston | 401/208 X |

FOREIGN PATENT DOCUMENTS

| | | | |
|---|---|---|---|
| 675043 | 10/1929 | France | 223/79 |

OTHER PUBLICATIONS

"Decorative Mazda Lamps", The Protective Electrical Supply Co. Catalog, p. 371, 1919.

*Primary Examiner*—Clifford D. Crowder
*Assistant Examiner*—Bibhu Mohanty
*Attorney, Agent, or Firm*—Willian Brinks Olds Hofer Gilson & Lione

[57] ABSTRACT

An athletic glove pocket-forming and shaping device has been invented which, in preferred embodiments, comprises a pocket formation bulbous member in a generally pear-shaped configuration, with a first large end for forming a pocket and a second smaller tapered end for forming a heel taper in the glove. The preferred embodiments also include a means for supplying heat from the device to a glove in which the device is placed, a conditioning fluid compartment inside the bulbous member and in fluid contact with a conditioning fluid applicator, a hinge-forming spine and a barrier ridge-forming spine on the surface of the bulbous member adjustably spaced from one another and one or more restraining straps for securing the athletic glove in a closed form around the bulbous member.

41 Claims, 3 Drawing Sheets

ATHLETIC GLOVE POCKET FORMER, SHAPER AND CONDITIONING DEVICE

BACKGROUND OF THE INVENTION

The present invention relates to devices for forming a pocket in and otherwise shaping and conditioning an athletic glove such as a baseball glove.

To be most useful to a player, it is necessary that an athletic glove such as a baseball glove close on and grip a ball properly. When a glove does not perform well, it is usually because the glove was not of the proper shape prior to engagement of the ball or because the surfaces of the glove contacting the ball were not of a proper finish and texture to restrain the ball.

Traditionally, players have tried to shape their gloves by placing one or more balls into the glove and securing them with a belt, rope or similar restraint strap to help form a pocket in the glove. They have also tried to improve the gripping capabilities of their gloves by the application of a conditioning fluid or dressing. Results have not generally been to the liking of the players. This has been due, in part, to the inconsistent nature of application of these techniques as well as their technical inadequacies.

Several previously issued patents disclose athletic glove pocket-forming devices. For example, U.S. Pat. No. 4,765,519 to Groves discloses an athletic glove pocket former comprising a ball-like object with a bendable strap secured thereto. The strap is attached to the ball in the approximate middle of the strap via velcro. Velcro is also used on the terminal ends of the strap to secure the ends of the strap around the glove.

U.S. Pat. No. 5,000,317 to Cich discloses a sports glove storage ball comprised of a hollow, plastic sphere with a strap protruding therefrom. The sphere opens for storage of a baseball or softball. The sphere is then placed in the pocket of a baseball or softball glove and the strap is wrapped around the glove. A buckle on the other end of the strap also protrudes from the sphere and is used to join the two strap ends.

U.S. Pat. Nos. 4,958,729 and 4,883,170 both to Wright disclose a ball glove conditioning bag. The bag is zippered and contains straps inside that wrap around the glove in a figure "8" pattern to hold the glove closed. In the '170 patent, a foam ball with conditioning fluid is placed inside the pocket of the glove. In the '729 patent, a rigid ball inside a tube of conditioning fluid absorbent material is used to help shape the pocket.

U.S. Pat. No. 4,877,162 to McGinley discloses a baseball glove shaper with three or more arms made of wire and covered with a soft material. The arms are bent to a shape desired for a particular glove. The arms join together at a base junction which serves to help form the pocket. The free end of the arms attach to the lacing at the finger and thumb ends of the glove. The covers of the arms may include ribs to enhance frictional effects between the glove and the device. The device is used for breaking in a new glove and to thereafter help the glove maintain its shape.

U.S. Pat. No. 4,418,849 to Santa discloses a baseball glove former and carrier. The carrier has a molded plastic clam, shell-like body to surround the glove. Optionally a ball, attached to the body by a strap, is placed inside the glove to help maintain the pocket.

While these devices have been of some improvement to the simple ball and belt approach, they have not been widely used and, for purposes of forming a proper shape in the glove, are no better than the simple ball and belt. Thus, there still exists a need for an athletic glove former, shaper and conditioning device that can be used to properly form a glove during the break-in period and may be used thereafter to maintain the shape of the glove.

SUMMARY OF THE INVENTION

An athletic glove pocket-forming and shaping device has been invented which significantly improves over the prior art devices. In one aspect the athletic glove forming and shaping device comprises a pocket formation bulb in a generally pear-shaped configuration, with a first large end for forming a pocket and a second smaller tapered end for forming a heel taper in the glove. In another aspect the invention comprises a pocket-forming bulbous member and a means for supplying heat from the device to a glove in which the device is placed. In yet another aspect the invention comprises a pocket-forming bulbous member with a conditioning fluid compartment inside, preferably in fluid contact with a conditioning fluid applicator. In still yet another aspect the invention comprises a pocket-forming bulbous member having a pear-shaped configuration, a hinge-forming spine on the surface of the bulbous member, a barrier ridge-forming spine on the surface of the bulbous member and spaced from the hinge-forming spine and at least one restraining strap for securing the athletic glove in a closed form around the bulbous member.

In preferred embodiments the spacing between the hinge-forming spine and barrier ridge-forming spine is adjustable to accommodate different athletic gloves. The bulbous member is hollow and has compartments for both a conditioning fluid and a heating medium, with a flat cap on the large end recloseably sealing the heating medium compartment and a recloseable fluid compartment disposed in the small end. The flat cap allows the device to stand on its end when not in use. Also, the restraining strap is preferably slidably attached to an attachment band on the surface of the bulbous member.

The device of the present invention is particularly well adapted for forming and maintaining a pocket area and heel taper area in the glove, the two areas jointly acting as a guide for positioning and entrapping a ball entering the glove. With the preferred embodiment, the spines form a crease in the hinge area and a barrier ridge at the end of the pocket area. The crease causes the finger section of the glove to pivot at the hinge area so as to entrap and contain the ball within the pocket. The barrier ridge facilitates entrapment and griping the ball in the glove. Also, with the preferred embodiment, a conditioning fluid is readily available and can be applied to selected glove surfaces. The heating provided by the device helps the glove absorb the conditioning fluid.

These and other advantages of the invention, as well as the invention itself, will be best understood in reference to the appended drawings, a brief description of which follows.

DETAILED DESCRIPTION OF THE DRAWINGS AND PREFERRED EMBODIMENTS OF THE INVENTION

The present invention is useful in shaping a number of types of athletic gloves, including but not limited to, baseball gloves, softball gloves, stickball gloves, goalie gloves and the like. The invention is particularly well suited for breaking in new athletic gloves, but will also be used to revitalize a glove that has been mistreated or improperly cared for, as well as for maintaining a glove once properly conditioned.

Figure 1:
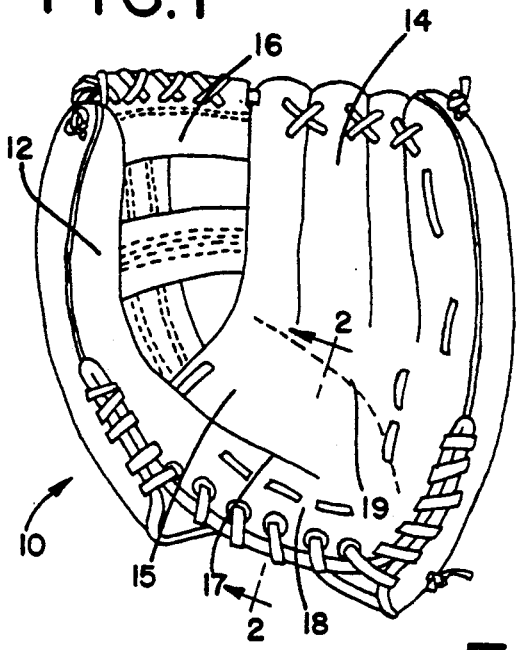
FIG. 1 is a perspective view of a typical athletic glove.
Figure 2:
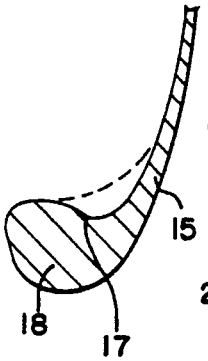
FIG. 2 is a partial sectional view of the pocket area of the glove taken along line 2—2 of FIG. 1.

A typical athletic glove 10 as shown in FIG. 1 usually comprises a thumb section 12, a finger section 14, a web 16 and a heel 18. At the base of the web 16 is the pocket 15. The base of the pocket 15 terminates at the heel 18 in a barrier ridge 17. The base of the finger section 14 terminates at the pocket 15 in a closing hinge 19. The closing hinge 19 allows the finger section 14 to move with respect to the pocket area 15 when the glove 10 is closed to entrap a ball. The barrier ridge 17 is elevated With respect to the pocket 15 to such an extent (FIG. 2) that the ridge 17 formed at the junction of these components of a glove 10 presents a barrier that precludes a ball from readily and unintentionally exiting the glove.

Figure 3:
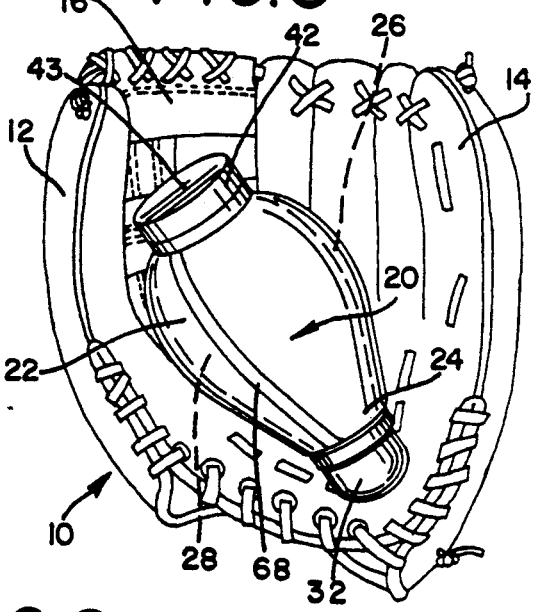
FIG. 3 is a perspective view of the glove of FIG. 1 with the bulbous member of the pocket-forming, shaping and conditioning device of the present invention in the pocket area of the glove of FIG. 1.
Figure 4:
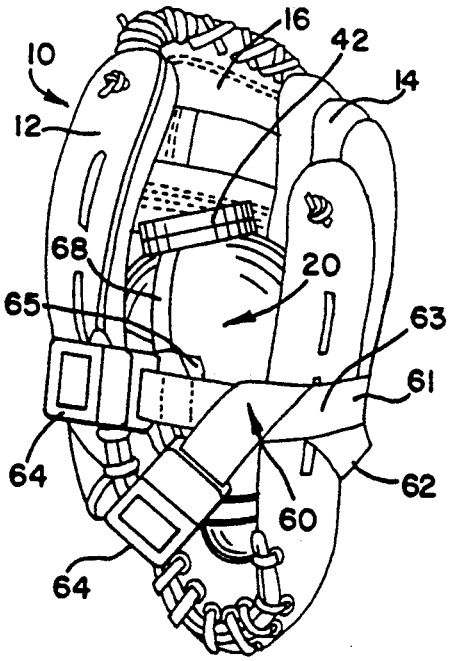
FIG. 4 is a perspective view of the entire pocket-forming shaping and conditioning device of the present invention in use in the glove of FIG. 1.

The athletic glove pocket former, shaper and conditioning device of the preferred embodiment of the invention comprises two major assemblies—a bulbous member 20 (FIGS. 3 and 5) and a restraining strap assembly 60 (best seen in FIG. 4).

Figure 5:
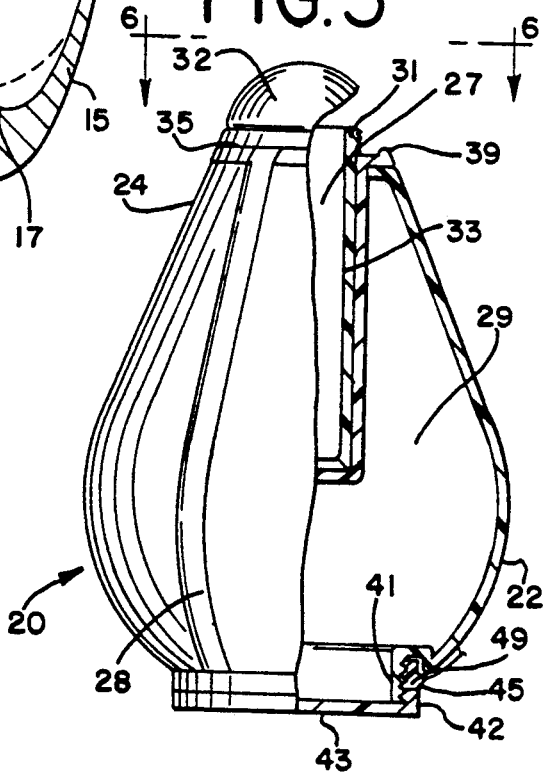
FIG. 5 is a partially sectional-elevational view of the bulbous member of the glove former and shaper of FIG. 3 standing on its end as during non-use.

The bulbous member, or pocket formation bulb 20, has a generally pear-shaped configuration, as best seen in FIG. 5, with a first large end 22 and a second smaller tapered end, or heel taper extension 24.

The first large end 22 of the pocket formation bulb 20 is sized and shaped to enhance the establishment and formation of a pocket area 15 to entrap and hold a ball. The heel taper extension 24 is sized and shaped to form the heel taper, which is that area of the glove located between the pocket 15 and the junction of the heel 18 and finger section 14. Proper establishment of the heel taper is critical for the proper functioning of the closing hinge 19 and the barrier ridge 17, and for the proper formation and functioning of the pocket 15.

Figure 6:
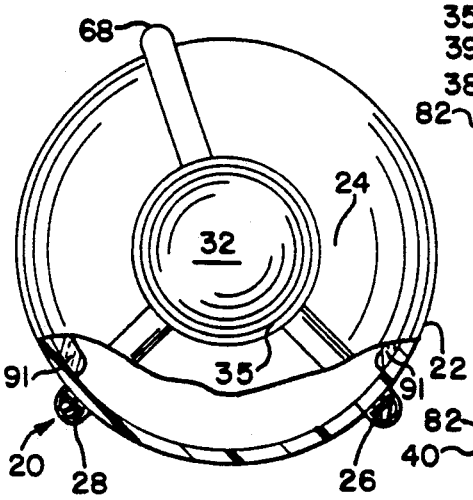
FIG. 6 is a top plan view, partially cut away, taken along line 6—6 of FIG. 5.

As shown in FIGS. 5 and 6, on the outside surface of the pocket formation bulb 20, running between the first large end 22 and the second smaller end 24 are two spines—a hinge-forming spine 26 and a barrier ridge-forming spine 28. The ridge-forming spine 28 forms the barrier ridge 17 that facilitate the positive gripping of a ball. The hinge-forming spine 26 is sized and shaped to enhance the establishment and formation of the closing hinge 19. A third element, an attachment band 68, described fully hereafter, also lies on the surface of the bulbous member 20 and runs between the first large end 22 and the second smaller end 24.

Figure 7:
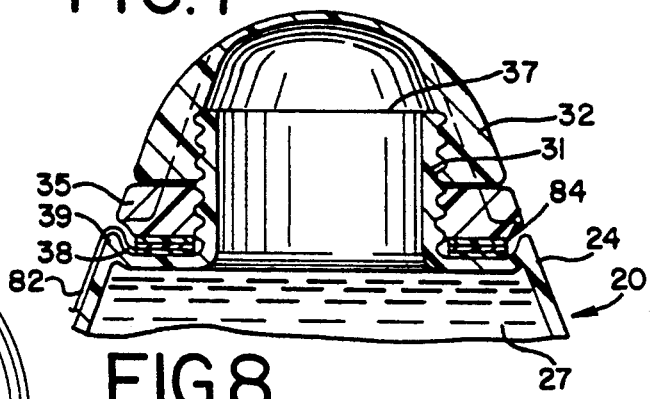
FIG. 7 is an enlarged cross-sectional view of a second embodiment of the small tapered end of the bulbous member of FIG. 5.

In its preferred embodiment, the bulbous member 20 is hollow. It can comprise one compartment (FIGS. 7 and 8) or preferably two distinct compartments (FIG. 5) or cavities inside. The single compartment, or one of the two compartments, may be a conditioning fluid storage compartment 27 as in FIGS. 5, 7 and 8, used to store an athletic glove conditioning fluid or dressing within the device. The single compartment (or the other compartment in FIG. 5) may be a heated medium storage compartment 29. In the two compartment embodiment (FIG. 5), the conditioning fluid storage compartment 27 is provided by a cylindrical insert 33. Where only one compartment is provided, it can be either a conditioning fluid storage compartment 27 (FIGS. 7 and 8) or a heated medium storage compartment 29.

Where the device includes a conditioning fluid storage compartment 27, the conditioning fluid or dressing may simply be poured out of the compartment 27 through an orifice 37 (FIG. 7). More preferably, however, the conditioning fluid is dispensed by a means, such as a rotating applicator ball 34 (FIG. 8), that will apply it only to those selected areas of the glove with which the applicator ball 34 comes into contact. When so used, the compartment 27 is closed by the applicator ball 34 positioned and supported by the ball guides and drip seals 36. In either embodiment, the orifice 37 or the applicator ball 34 can be accessed by means of a removable cap 32 that also serves as the end section of the heel taper extension 24 of the pocket formation bulb 20. A flexible attachment cord 40 (FIG. 8) preferably joins the removable cap 32 to the heel taper extension 24 and permits rotary motion between the device and the cap 32 while precluding separation of the cap 32 from the device.

The compartment 29 (FIGS. 5 and 9) can be filled with a heated liquid, solid or granulated solid to enable the device to warm a glove 10 and thereby soften the glove material and to enhance its ability to absorb a conditioning fluid or dressing. When so used, the compartment 29 can be accessed by means of a removable cap 42 that also serves as the end section of the large end 22 of the pocket formation bulb 20. In the preferred embodiment, the cap 42 has a generally flat end surface 43 used for standing the device up when it is not in use.

Figure 8:
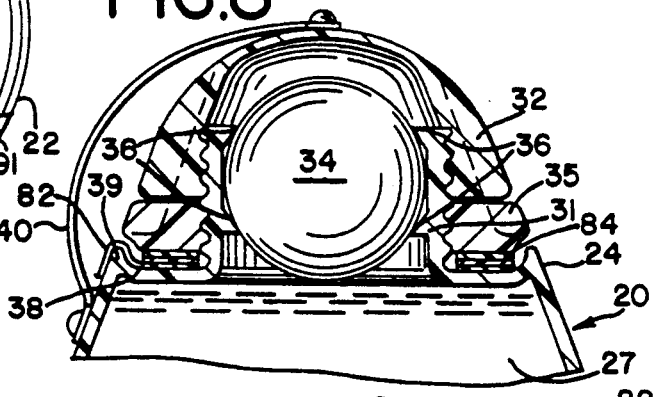
FIG. 8 is an enlarged cross-sectional view of a third embodiment of the small tapered end of the bulbous member of FIG. 5.
Figure 9:
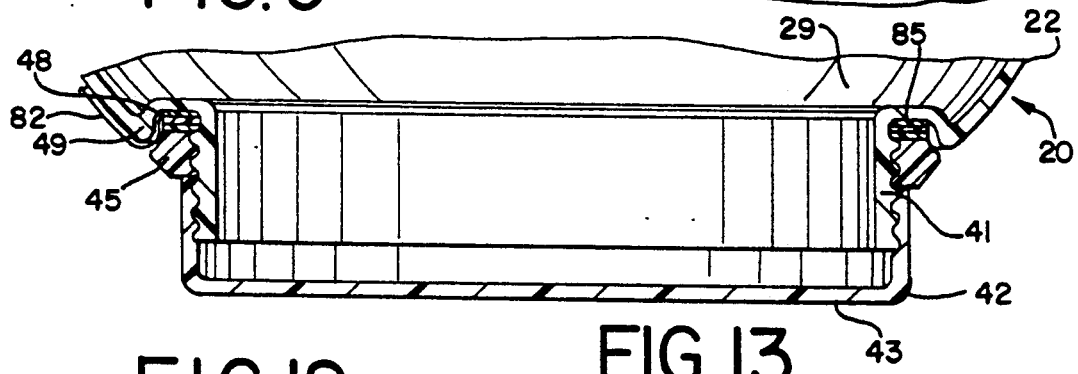
FIG. 9 is an enlarged cross-sectional view of the end cap on the large end of the bulbous member of FIG. 5.

Each end of the bulbous member 20 is preferably formed with externally threaded ends at the orifice of the compartments, such as by the use of nipples 31 and 41 (FIGS. 7-9). A nut 35 is mounted on the externally threaded orifice of the conditioning fluid compartment 27. A nut 45 is mounted on the externally threaded orifice to the heated medium storage compartment 29. A loop compression lip 39 is located on the end of the tapered end 24 (FIGS. 7 and 8) and a loop compression lip 49 is located on the end of the first large end 22 (FIG. 9). These lips 39 and 49 respectively provide recesses 38 and 48 at the base of nipples 31 and 41.

Figure 10:
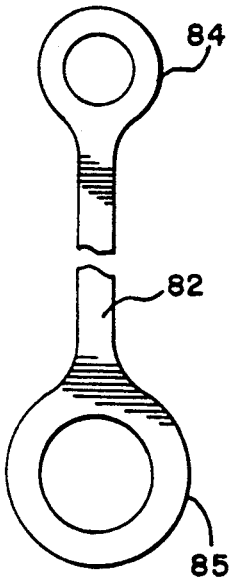
FIG. 10 is a plan view of the attachment band used on the bulbous member of FIG. 6.

The barrier ridge-forming spine 28 and hinge-forming spine 26 (FIG. 11) and the restraint strap attachment band 68 (FIG. 10) are all of the same general shape when observed in the plan view. They each comprise a band section 82 and end loops 84 and 85, by which the spine or band is attached to the body of the device. The two end loops 84 and 85 are of a different size to fit respectively around the externally threaded nipples 31 and 41. This configuration allows the loops 84 and 85 to be rotated with respect to the nipples 31 and 41, which thus allows the position of the spines 26 and 28 and the attachment band 68 on the surface of the bulbous member 20 to be varied. Hence, the distance between the spines 26 and 28, and the attachment band 68, is adjustable, which allows the device to be used on different gloves 10.

Figure 12:
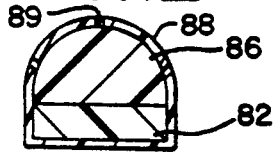
FIG. 12 is a cross-sectional view of one of the spines used on the bulbous member of FIG. 6, taken along line 12—12 of FIG. 11.
Figure 11:
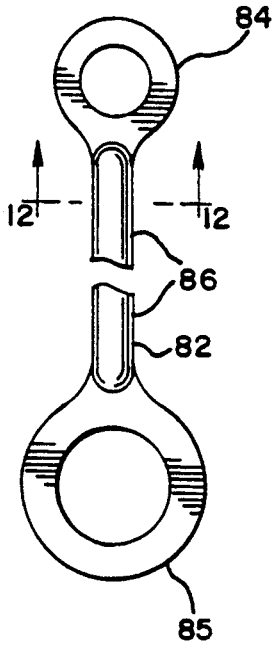
FIG. 11 is a plan view of the hinge-forming spine and barrier ridge-forming spine used on the bulbous member of FIG. 6.

As best seen in FIGS. 11 and 12 the spines 26 and 28 further comprise a material 86 covering the band section 82 to provide a crease-forming ridge on the spine. Preferably the material 86 will also readily absorb a lubricant or dressing and then meter it out at a controlled rate. This material is selectively positioned to enable the device to apply a lubricant or dressing onto those portions of the surface of a glove with which this material is in direct physical contact.

In spines 26 and 28, the material 86 is preferably held to the band 82 by an external compression sleeve 88 (FIG. 12). The sleeve 88, preferably made of a low durometer rubber, holds the material 86 to the band 82 by being stretched over and encircling the two elements. The sleeve 88 may also be made of a heat shrinkable material such as an appropriate PVC formulation. Preferably the sleeve 88 will include perforations 89, or be made of a material that will allow the transfer of dressing or conditioning fluid from the material 8 to the glove 10.

As best seen in FIG. 4, the restraint strap assembly 60 preferably comprises two straps 61 and 62 joined together at a cross over point 63. Buckle members 64 are provided on the straps 61 and 62 to fasten the ends together. The straps could also use velcro, buttons, zippers, hook and ring or any other suitable fastening system. Preferably, the strap 61 has an interface link 65 attached thereto, terminating in a slider 66 that encircles the attachment band 68. (FIG. 11).

Proper orientation of the device within a glove 10, prior to the engagement of the restraint strap assembly 60, is illustrated in FIG. 3. In FIG. 4, a glove with the device properly positioned and the restraint strap engaged is illustrated.

Proper attachment of the device to the glove 10 consists, first, of orientation of the device within the glove 10, then correctly positioning and securing of the adjustable features of the device and, finally, alignment and attachment of the device within the glove 10. More specifically, the pocket formation bulb 20 is set well within the pocket area 15 of the glove 10, with the heel taper extension 24 of the pocket formation bulb positioned into the junction of the heel 18 and the finger section 14 of the glove 10 (FIG. 3). The hinge-forming spine 26 is then aligned with and upon the hinge area 19 of the glove 10. The barrier ridge-forming spine 28 is aligned with the junction of the pocket area 15 and the heel 18. The restraint strap attachment band 68 is positioned so that it is located on the exposed surface of the device between the thumb section 12 and the finger section 14 of the glove 10 when the glove is wrapped around the device.

The spines 26 and 28 and restraining strap attachment band 68 are then secured in these positions by fastening the top nut 35 and the bottom nut 45. Not only does this action force the end loops 84 and 85 of each of the spines 26 and 28 and the attachment band 68 into the recesses 38 and 48 and the extremities of the band sections 82 over and against the friction lips 39 and 49, but it also applies tension to the band sections 82 of the spines 26 and 28 and restraining strap attachment band 68 and pulls them against the external surfaces of both the first large end 22 and the heel extension 24. The spines 26 and 28 and restraint strap attachment band 68 are rendered immobile by the high level of friction encountered in the loop recesses 38 and 48, at the friction lips 39 and 49 and along the surface of the bulbous member 20.

The restraint strap assembly 60 is then properly positioned around the glove 10 and secured so as to force the pocket area 15, heel taper area, closing hinge 19 and barrier ridge 17 of the glove 10 into firm and consistent contact with the device.

Figure 14:
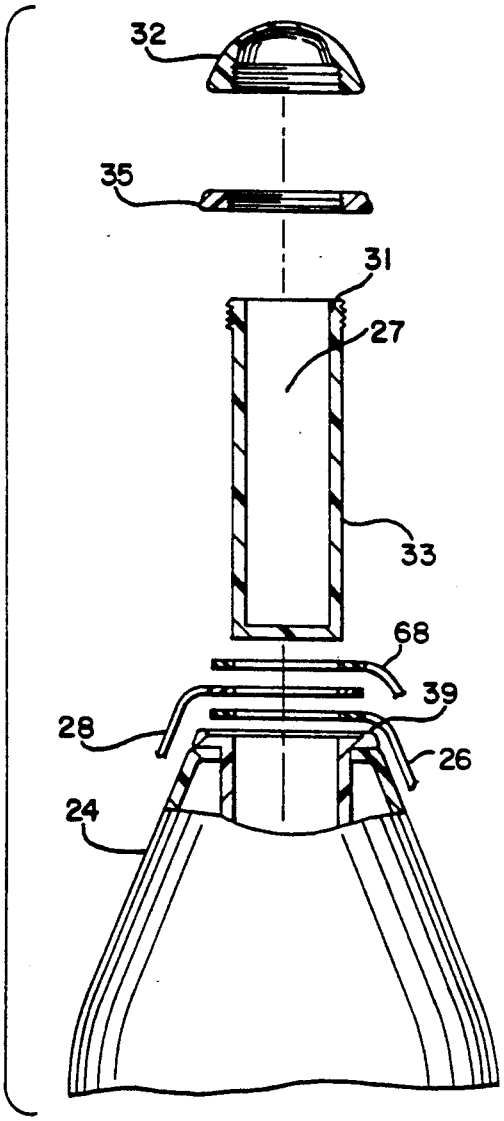
FIG. 14 is an exploded view of the bulbous member of FIG. 5.

In the preferred embodiment, the conditioning fluid storage compartment 27 may be molded as a plastic insert member 33 that is then inserted into a molded plastic member which forms the heated medium storage compartment 29 as shown in FIG. 5. As shown in FIG. 14, the use of the plastic insert member 33 simplifies construction in that the attachment band 68 and spines 26 and 28 do not need to be stretched to position their end loops 84 over the nipple 31. Instead, the end loops 84 are put in their proper position and insert member 33 slides down through the hole in the end loops 84.

Figure 12A:
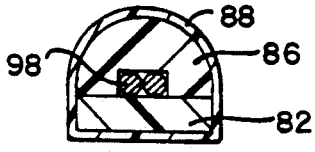
FIG. 12A is a cross-sectional view as in FIG. 12 showing another embodiment of the spines provided with an electrical resistance heating element.
Figure 13:
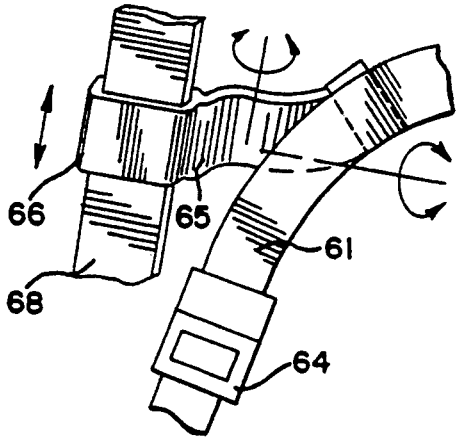
FIG. 13 is a perspective view showing the slidable attachment of the restraining straps to the attachment band of FIG. 10.
Figure 15:
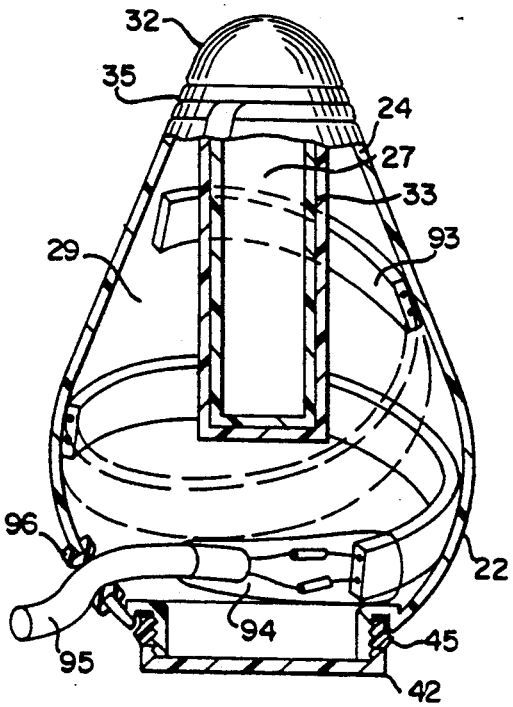
FIG. 15 is a partially sectional view showing another embodiment of the bulbous member of FIG. 5 provided with an electrical resistance heating element.

In another preferred embodiment (FIG. 15), heating is provided by an electrical heating element 93. Preferably the heating element 93 is a flexible resistance heating element, such as a flexible heat tape. When used, the heating element 93 may connect to an insulated electrical junction 94 inside the bulbous member 20, the junction leading to a suitable electrical cord 95 and plug for connecting to an electrical power supply. Preferably a bushing 96 seals the bulbous member 20 where the cord 95 enters and is configured to provide stress relief so that tension on the cord 95 is not transmitted to the junction 94. Alternatively, or simultaneously, a heating element 98 could be provided in one or both of the spines 26 and 28, as shown in FIG. 12A. The heating element 98 heats the portion of the surface of the glove 10 in contact with the spines when a suitable current is supplied. Again the heating element 98 is preferably in the form of a flexible heat tape embedded under the ridge forming material 86, joined to a suitable electrical cord (not shown). Alternatively the heating element 93 (and/or 98) could be battery operated.

Preferably the bulbous member 20 has sectionally different heat transfer properties so as to transfer heat differently to various sections of the glove 10 in which it is placed. For example, the walls of the bulbous member 20 could be partially covered with an insulation material 91 (FIG. 6) or made thicker in areas except where heat is to be readily supplied to the glove 10. Also, the bulbous member 20 could be formed of materials with different heat transfer properties. Preferably, the area at or between the spines 26 and 28 will be the most heat conductive.

The band section 82 and end loops 84 and 85 are preferably formed of a properly flexible material, such as plastic, leather, a woven fabric or metallic material. The material 86 that provides a crease-forming ridge is preferably a suitably resilient material of fibrous or open cell configuration, such as woven fabric, cordage or a semi-rigid foam. The end caps 32 and 42 and compartments 27 and 29 are preferably formed of a properly rigid metallic or plastic material, such as PVC. The size of the device is proportional to the size of the glove and to the size of the ball to be contained and handled. While the preferred embodiment uses bands 82 with two end loops 84 and 85, in embodiments where only one compartment is used and there is only one opening, an end loop need be formed only on the end of the band 82 which corresponds to that opening, the other end of the band 82 being rotatably secured to the end of the bulbous member 20 opposite that opening by any other suitable means. Also, rather than forcing the end of the band 82 over the lip 39 or 49, the loop 84 or 85 could be forced outwardly by turning the nut 35 or 45, thus displacing the end loop and stretching the band, or the loops at each nipple could be forced together at surface 38 or 48 to effect immobilization of the loops 84 and 85.

Some of the benefits of the preferred embodiment of the invention include the capability to create, in the glove, a heel taper area, a barrier ridge, and a closing hinge. The closing hinge and barrier ridge are formed by external spines that are movable and can be located to conform to the unique geometric characteristics of a specific glove.

The preferred embodiment includes the capability to apply a conditioning fluid or dressing to predetermined locations on the surface of the glove and, thereby, to selectively treat specific areas of the glove. The preferred embodiment also has the capability to heat the glove, to soften it and to help enhance the absorption of a conditioning fluid or dressing, and to selectively heat specific areas of the glove.

The restraint strap is secured to the device by an interface link 65 and slider 66 that permit both lateral and rotational movement between the strap assembly 60 and bulbous member 20, allowing a strap that is not laterally flexible to conform to gloves of various geometries. The interface link 65 provides a stress relief feature, so as to minimize tension between strap 61 and slider 66, as well as to avoid deflection or distortion to a glove secured to the device. While two restraining straps have been found beneficial in holding the glove in the proper shape around the device and applying pressure in the correct areas, in some embodiments a single strap may be sufficient, or more than two straps may be needed.

It should be appreciated that the apparatus of the present invention is capable of being incorporated in the form of a variety of embodiments, only a few of which have been illustrated and described above. The invention may be embodied in other forms without department from its spirit or essential characteristics. For example, heat could also be generated by an exothermic chemical reaction. Other conditioning fluid applicators, such as a sponge tip in fluid contact with the conditioning fluid storage compartment 27, could be used instead of the captured, rotatable applicator ball 34. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

I claim:

1. An athletic glove pocket-forming and shaping device comprising:

a) a pocket formation bulb in a generally pear-shaped configuration, with a first large end for forming a pocket and a second smaller end for forming a heel taper in the glove;

b) at least one spine protuding from the surface of the pocket formation bulb running between the first large end and the second smaller tapered end; and c) one or more straps attached to the pocket formation bulb for holding the glove closed around the pocket formation bulb.

2. The athletic glove pocket-forming and shaping device of claim 1 wherein the at least one spine comprises a hinge-forming spine.

3. The athletic glove pocket-forming and shaping device of claim 1 wherein the at least one spine comprises a barrier ridge-forming spine.

4. The athletic glove pocket-forming and shaping device of claim 3 further comprising a second spine, wherein said second spine comprises a barrier ridge-forming spine on the surface of the pocket formation bulb and running between the first large end and the second smaller tapered end.

5. The athletic glove pocket-forming and shaping device of claim 4 wherein the distance between the barrier ridge-forming spine and hinge-forming spine is adjustable.

6. The athletic glove pocket-forming and shaping device of claim 1 wherein the first end terminates in a generally flat end surface for standing the device thereon when not in use.

7. An athletic glove pocket-forming and shaping device comprising a pocket forming generally pear-shaped bulbous member, one or more spines protruding from the surface of the bulbous member, and an electrical heating element placed inside one or more said spines.

8. The athletic grove pocket-forming and shaping device of claim 8 wherein the bulbous member has sectionally different heat transfer properties so as to transfer heat differentially to different sections of a glove in which it is placed.

9. The athletic glove pocket-forming and shaping device of claim 8 further comprising a conditioning fluid storage compartment.

10. An athletic glove pocket-former, shaper and conditioning device comprising:

a) a pocket-forming, generally pear-shaped bulbous member with a first large end and a second smaller end;

b) at least one spine protruding from the surface of the pocket-forming bulbous member running between the large end and the smaller end; and c) a conditioning fluid storage compartment containing an athletic glove conditioning fluid within said bulbous member.

11. The athletic glove pocket-former, shaper and conditioning device of claim 10 further comprising a conditioning fluid applicator in fluid contact within said compartment.

12. The athletic glove pocket-former, shaper, and conditioning device of claim 10 further comprising an orifice providing an outlet to said compartment and a removable cap for closing said orifice.

13. The athletic glove pocket-former, shaper, and conditioning device of claim 11 wherein the conditioning fluid applicator comprises a captured rotatable ball.

14. An athletic glove pocket-former, shaper and conditioning device comprising:

a) a pocket-forming bulbous member having a pear-shaped configuration;

b) a hinge-forming spine on the surface of the bulbous member;

c) a barrier ridge-forming spine on the surface of the bulbous member and spaced from said hinge-forming spine; and d) at least one restraining strap for securing the athletic glove in a closed form around the bulbous member.

15. The athletic glove pocket-former, shaper and conditioning device of claim 14 further comprising a restraining strap attachment band on the surface of the bulbous member for keeping the at least one restraining strap attached to the bulbous member.

16. The athletic glove-former, shaper, and conditioning device of claim 15 wherein the positions of the attachment band, hinge forming spine and barrier ridge forming spine are all adjustable with respect to one another.

17. The athletic glove pocket-former, shaper and conditioning device of claim 15 wherein the at least one restraining strap is fastened to as slider which is slidably secured to the attachment band.

18. The athletic glove pocket-former, shaper and conditioning device of claim 17 further comprising an interface link between the slider and the at least one restraining strap.

19. The athletic glove pocket-former, shaper and conditioning device of claim 14 wherein at least one of the hinge-forming and barrier ridge-forming spines comprise a material that will readily absorb a conditioning fluid and transfer the same to the glove at a controlled rate.

20. The athletic glove pocket-former, shaper and conditioning device of claim 14 wherein at least one of the hinge-forming spine and barrier ridge-forming spine comprise a band running between the ends of the pocket-forming bulbous member and the band is secured to the bulbous member on at least one end by an end loop around a nipple.

21. The athletic glove pocket-former, shaper and conditioning device of claim 20 further comprising a restraining strap attachment band on the surface of the bulbous member for keeping the at least one restraining strap attached to the bulbous member and wherein the attachment band also comprises a band running between the ends of the pocket-forming bulbous member and is secured thereto on at least end by a loop around said nipple.

22. The athletic glove pocket-former, shaper and conditioning device of claim 21 wherein the bulbous member further comprises a lip at the base of said nipple over which the bands are stretched.

23. The athletic glove pocket-former, shaper and conditioning device of claim 21 wherein the nipple is threaded and the bands can be tightened by rotating a nut on the threaded nipple, displacing the end loops and stretching the bands.

24. The athletic glove pocket-former, shaper and conditioning device of claim 23 further comprising an end cap on the threaded nipple and wherein said nut may be rotated independently of said end cap.

25. The athletic glove pocket-former, shaper and conditioning device of claim 14 wherein the at least one restraining strap comprises two restraining straps.

26. The athletic glove pocket-former, shaper and conditioning device of claim 14 wherein the barrier ridge-forming spine and hinge-forming spine comprise a band and a ridge forming member held together by a sleeve surrounding the band and ridge forming material.

27. A method for shaping an athletic glove to form a heel taper comprising:

a) providing an athletic glove;

b) providing a generally pear-shaped pocket formation bulb having a tapered end;

c) placing said pocket formation bulb in the glove;

d) securing the glove around the pocket formation bulb.

28. The method of claim 27 further comprising the step of applying a conditioning fluid to the glove before securing the glove around the pocket formation bulb.

29. The method of claim 27 further comprising the step of heating the glove while the glove is secured around the pocket formation bulb.

30. The method of claim 27 further comprising providing at least one spine on the surface of the pocket formation bulb for forming at least one of a barrier ridge or a hinge in the athletic glove.

31. A combination of an athletic glove pocket-forming and shaping device and an athletic glove comprising:

a) a pocket formation bulb in a generally pear-shaped configuration, with at first large end for forming a pocket and a second smaller tapered end for forming a heel taper in the glove; and b) an athletic glove secured around the pocket formation bulb.

32. The combination of claim 31 wherein the pocket formation bulb comprises one or more spines on the surface of the pocket formation bulb for forming one or both of a barrier ridge and hinge in the glove.

33. The combination of claim 31 further comprising a conditioning fluid storage compartment within the pocket formation bulb.

34. The combination of claim 33 containing a conditioning fluid within the conditioning fluid storage compartment.

35. The combination of claim 31 further comprising one or more straps attached to the pocket formation bulb securing the glove closed around the pocket formation bulb.

36. The combination of claim 31 further comprising a heated material inside a cavity in said pocket formation bulb.

37. The combination of claim 36 further comprising a removable cap on the device providing an access to the cavity for replacing the heated material.

38. The combination of claim 31 further comprising an electrical heating element inside said pocket-forming and shaping device.

39. The combination of claim 38 wherein the electrical heating element comprises a resistance heating element inside the pocket formation bulb.

40. The combination of claim 38 further comprising one or more spines on the surface of the pocket formation bulb and wherein the electrical heating element comprises a resistance heating element inside one or more of said one or more spines.

41. The combination of claim 39 further comprising one or more spines on the surface of the pocket formation bulb and wherein the electrical heating element further comprises a resistance heating element inside one or more of said one or more spines.

* * * * *

UNITED STATES PATENT AND TRADEMARK OFFICE

CERTIFICATE OF CORRECTION

PATENT NO. : 5,267,677
DATED : December 7, 1993
INVENTOR(S) : Lawrence A. Nash

It is certified that error appears in the above-indentified patent and that said Letters Patent is hereby corrected as shown below:

In column 1, line 63, after "clam" delete ",".

In column 3, line 62, delete "With" and substitute --with--.

In column 5, line 51, delete "8" and substitute --86--.

IN THE CLAIMS

Column 8:

In Claim 4, line 2, delete "3" and substitute --2--.

In Claim 8, line 1, delete "grove" and substitute --glove--,

In Claim 8, line 2, delete "8" and substitute --7--.

In Claim 9, line 2, delete "8" and substitute --7.--.

UNITED STATES PATENT AND TRADEMARK OFFICE

CERTIFICATE OF CORRECTION

PATENT NO. : 5,267,677
DATED : December 7, 1993
INVENTOR(S) : Lawrence A. Nash

It is certified that error appears in the above-indentified patent and that said Letters Patent is hereby corrected as shown below:

IN THE CLAIMS (cont'd)

Col. 9: In Claim 17, line 3, delete "as" and substitute --a--.

Col. 10: In Claim 31, line 5, delete "at" and insert --a--.

Signed and Sealed this

Sixth Day of December, 1994

Bruce Lehman

*Attest:*

BRUCE LEHMAN

*Attesting Officer*

*Commissioner of Patents and Trademarks*